US009955746B2

(12) United States Patent
Dick

(10) Patent No.: US 9,955,746 B2
(45) **Date of Patent: *May 1, 2018**

(54) HEAD GARMENT FOR PRIVACY

(71) Applicant: Dicksbridge, Inc., Lake Forest, IL (US)

(72) Inventor: John H. Dick, Lake Forest, IL (US)

(73) Assignee: DICKSBRIDGE, INC., Lake Forest, IL (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/463,979

(22) Filed: Mar. 20, 2017

(65) Prior Publication Data

US 2017/0188652 A1 Jul. 6, 2017

Related U.S. Application Data

(63) Continuation of application No. 14/046,665, filed on Oct. 4, 2013, now Pat. No. 9,629,411.

(51) Int. Cl.

| | |
|---|---|
| ***A41D 13/00*** | (2006.01) |
| ***A42B 1/00*** | (2006.01) |
| ***A42B 1/04*** | (2006.01) |
| ***A42B 5/00*** | (2006.01) |
| ***A42C 5/04*** | (2006.01) |
| ***A42B 1/06*** | (2006.01) |

(Continued)

(52) U.S. Cl.

CPC ..... *A42B 5/00* (2013.01); *A42B 1/008* (2013.01); *A42B 1/067* (2013.01); *A42B 1/22* (2013.01); *A42B 1/245* (2013.01); *A42C 5/04* (2013.01)

(58) Field of Classification Search

CPC ..... A42B 1/18; A42B 1/008; A42B 1/067; A42B 1/22; A42B 1/24; A42B 1/245; A42B 1/046; A42B 1/066; A42B 1/048; A42B 1/201; A42B 5/00; A42B 7/00; A42B 3/286; A41D 13/11; A41D 13/001; A41D 13/1161; A01K 55/00; A42C 5/04

USPC .... 2/4, 8.6, 9, 171, 171.03, 171.3, 172, 183, 2/174, 202, 206, 207, 209.13, 175.6

See application file for complete search history.

(56) References Cited

U.S. PATENT DOCUMENTS

| | | | |
|---|---|---|---|
| 766,426 | A | 8/1904 | Comstock |
| 1,004,507 | A | 9/1911 | Walz |

(Continued)

FOREIGN PATENT DOCUMENTS

| | | | |
|---|---|---|---|
| CA | 2201973 | A1 | 10/1998 |

OTHER PUBLICATIONS

International Search Repcrt and Written Opinican for PCT/US2014/058215 dated Jan. 2, 2015.

*Primary Examiner* — Jameson Collier
(74) *Attorney, Agent, or Firm* — Cook Alex Ltd.

(57) ABSTRACT

A head garment for privacy and methods of using the same. The head garment has a frame including an elongated member, the frame including a loop portion that extends upward and forward from a rear portion that includes a tail, the loop portion including a rim, a veil having a rear portion that is connected to the rear portion of the frame and a front portion that is connected to the rim. The tension in the portion of the veil that spans between the connection to the rear portion of the frame and to the rim provides support for the rim, and the front portion of the veil extends beyond and drapes downward from the rim. The head garment is usable with a ventilation system and/or an electronic device and may be folded for stowing in a container.

21 Claims, 10 Drawing Sheets

(51) Int. Cl.
*A42B 1/22* (2006.01)
*A42B 1/24* (2006.01)

(56) References Cited

U.S. PATENT DOCUMENTS

| | | | | |
|---|---|---|---|---|
| 1,164,351 | A | 12/1915 | Hulstrom | |
| 1,222,995 | A | 4/1917 | Rhoades | |
| 1,241,858 | A | 10/1917 | Koelsch | |
| 1,263,958 | A | 4/1918 | Strachan | |
| 1,287,478 | A | 12/1918 | Simpson | |
| 1,332,287 | A | 3/1920 | Champman | |
| 1,481,541 | A | 1/1924 | Douglas | |
| 1,671,889 | A | 5/1928 | Dorros | |
| 1,933,477 | A | 10/1933 | Jordan | |
| 2,119,439 | A | 5/1938 | Parmelee | |
| 2,353,025 | A | 6/1941 | Gautreaux | |
| 2,367,006 | A | 9/1942 | Cope | |
| 2,332,662 | A | 10/1943 | Nathanson | |
| 2,443,848 | A | 6/1948 | Boeringer | |
| 2,472,033 | A | 5/1949 | Wetzel | |
| 2,586,700 | A | 7/1951 | Noble | |
| 2,704,366 | A | 10/1952 | Arnold | |
| 3,016,545 | A | 1/1962 | Donahue | |
| 3,288,157 | A | 11/1966 | Szkolny | |
| 3,298,031 | A | 1/1967 | Morgan | |
| 3,471,867 | A | 10/1969 | Kirchoff | |
| 3,529,594 | A | 9/1970 | Charnley | |
| 3,587,114 | A | 6/1971 | McCourtie | |
| 3,683,907 | A | 8/1972 | Cotabish | |
| 3,990,112 | A | 11/1976 | Ciffolillo | |
| 4,141,083 | A | 2/1979 | Waters | |
| 4,150,443 | A | 4/1979 | McNeilly | |
| 4,214,318 | A | 7/1980 | Gomez | |
| 4,364,123 | A | 12/1982 | Sam | |
| 4,887,316 | A | 12/1989 | Morandini | |
| 5,035,004 | A | 7/1991 | Koester | |
| 5,048,516 | A | 9/1991 | Soderberg | |
| 5,164,987 | A * | 11/1992 | Raven | H04R 1/10 381/309 |
| 5,367,706 | A | 11/1994 | Davidson | |
| 5,577,271 | A | 1/1996 | Davis | |
| 5,548,846 | A | 8/1996 | Bianchetti | |
| 5,617,584 | A | 4/1997 | Brennan | |
| 5,621,921 | A * | 4/1997 | Outland | A42B 1/02 2/171 |
| 5,694,647 | A | 12/1997 | Crickmore | |
| 5,867,833 | A * | 2/1999 | LeDonne | A41D 23/00 2/171 |
| 5,901,380 | A | 5/1999 | Mishal | |
| 5,924,129 | A | 7/1999 | Gill | |
| 5,933,871 | A | 8/1999 | Kraft | |
| 5,940,886 | A | 8/1999 | McCarthy Smith | |
| 5,978,967 | A | 11/1999 | Williams | |
| 6,298,492 | B1 | 10/2001 | Stirling | |
| 6,341,380 | B1 | 1/2002 | Coleman | |
| 6,374,423 | B1 | 4/2002 | Anderson et al. | |
| 6,523,182 | B1 | 2/2003 | Brawner | |
| 6,651,256 | B1 | 11/2003 | Swift | |
| 6,823,868 | B1 | 11/2004 | Begum | |
| 6,996,852 | B1 | 2/2006 | Cabrera | |
| 7,076,810 | B1 | 7/2006 | Rossini | |
| 7,114,194 | B2 | 10/2006 | English | |
| 7,143,451 | B2 | 12/2006 | Lundgren | |
| 7,143,452 | B1 | 12/2006 | Rossini | |
| 7,331,064 | B1 | 2/2008 | Quintal | |
| 7,503,079 | B1 | 3/2009 | Fletcher et al. | |
| D636,975 | S | 5/2011 | Fountain | |
| 2002/0056155 | A1 | 5/2002 | Watley | |
| 2004/0204207 | A1 | 10/2004 | Parker | |
| 2005/0132468 | A1 | 6/2005 | Lundgren | |
| 2006/0005300 | A1 | 1/2006 | St-Germain | |
| 2007/0258613 | A1 | 11/2007 | Wright | |
| 2008/0000014 | A1 | 1/2008 | No | |
| 2009/0000011 | A1 | 1/2009 | Halley | |
| 2009/0064394 | A1 | 3/2009 | White | |
| 2009/0178176 | A1 | 7/2009 | Rowe et al. | |
| 2010/0107318 | A1 | 5/2010 | Asta | |
| 2010/0229275 | A1 | 9/2010 | Wilson | |
| 2010/0306906 | A1 | 12/2010 | Hunt | |
| 2011/0094013 | A1 | 4/2011 | Zumwalt et al. | |
| 2011/0107500 | A1 | 5/2011 | Wathen | |
| 2013/0117899 | A1 | 5/2013 | Valentino | |
| 2013/0160195 | A1 | 6/2013 | Clement | |
| 2013/0239293 | A1 | 9/2013 | Wu | |
| 2013/0318685 | A1 | 12/2013 | Wood | |
| 2015/0089709 | A1 | 4/2015 | DuCasse | |

* cited by examiner

HEAD GARMENT FOR PRIVACY

CROSS-REFERENCE TO RELATED APPLICATION

This application is a continuation of and claims the benefit of U.S. patent application Ser. No. 14/046,665, filed Oct. 4, 2013, the disclosure of which is hereby incorporated by reference in its entirety.

BACKGROUND OF THE INVENTION

Field of the Invention

The present invention generally relates to devices or accessories that are worn on the head to enhance the privacy of a user, and more particularly to head garments that at least partially obstruct the view of a user, and methods of using the same. This disclosure presents example embodiments that are representative of such devices that may be utilized for particular purposes.

Discussion of the Prior Art

There have been many different devices used to shield a user's eyes and/or face from light, whether to protect one from the sun or to permit one to enjoy a darkened environment to promote sleep. These devices can find particular use in an indoor environment, such as when traveling on an airplane, or for use in an outdoor environment, such as when sitting on porch for a nap.

There are eye masks, which provide darkness but can be uncomfortable due to excess heat at the face and contact with the eyes. Such masks do not provide privacy from others for ones face. Nor do they provide any translucent vision to permit the user to see motion nearby. The masks also leave the user's mouth and nose completely exposed to airborne microbes and viruses.

Some may choose to place a blanket over one's head. However, this tends to be uncomfortable due to excessive heat. It also has a tendency to cause one's face to itch and sweat, while the weight of the blanket also may be fatiguing to one's neck. As with eye masks, blankets also tend not to permit translucent vision. Some may alternatively try using a hood having a drawstring to draw material over the head and eyes, but this tends to suffer similar disadvantages to the use of a blanket.

While one may decide to use medication, such as sleeping pills, instead of a device, such drugs tend to have a degrading effect which is not immediately reversible and takes time to dissipate. In addition, using medication provides no privacy, does not provide translucent viewing or any effect on the nearby air.

Additionally, there are masks of various types that are equipped with a pump to bring air to a user. However, such masks generally are for direct attachment to the user's face and often include a resilient band or other structure to seal the mask to the face. If a user is seeking to rest or sleep, this type of connection of a mask to the face to provide air flow is problematic because it can be uncomfortable, retain heat and impair the user's view at the user's face.

These prior art options have numerous disadvantages and fail to provide a satisfying solution. The present disclosure provides devices and methods of using the devices that address shortcomings found such prior devices.

SUMMARY OF THE INVENTION

The present disclosure generally provides example head garments and methods of using the same that enhance the privacy of a user, while at least partially obstructing the user's view outward and the view of the user's face by others, at a location that is spaced from the user's face. Such devices are well suited for promoting sleeping, such as on airplane seats or at other resting spots. The devices include very lightweight components that can be combined in customizable ways to shield a user's face. The head garments may be easily adjusted to accommodate various levels of inclination of the user, from sitting to prone positions, whether facing forward or laying on a side, without touching the face. They may be foldable to a compact size that may be carried in a briefcase, backpack, carryon bag or even a pocket of a jacket or overcoat. The devices also prevent exposing unflattering habits of a user, such as drooling or sleeping with an open mouth.

The head garments do not generate uncomfortable or excessive heat. They also provide a darkened space, which may help promote the release of melatonin, which may encourage sleep, while also permitting a user to have spatial and facial privacy. The head garments may provide some protection from coughing or sneezing from persons seated or passing nearby, and from airborne microbes and viruses. The devices further may allow a user to more easily selectively avoid conversations with others, by not being socially inviting. The head garments also do not prohibit certain activities. For instance, if desired, a user may drink a beverage with use of a straw, listen to music from an electronic device directly or via use of headphones, text or speak on a telephone or tele watch, view or use a video screen, or use an audio-visual device, such as a smart phone, for viewing and/or listening to entertainment, placing calls or otherwise communicating with the device. Indeed, in one example a hanger for an electronic device provides hands-free use of the electronic device which may be removably connected to the head garment.

The head garments of the present disclosure also may advantageously be used with optional ventilation systems to enhance a user's experience. The ventilation systems provide air flow to the user and may provide for selective conditioning of the air flowing to the private space underneath the veil and around the user's face. The ventilation systems are shown in example constructions that may include the use of inserts that are in the form of filters or pads to condition the air. The ventilation systems may include compartments at various locations including at an inlet, an outlet, or at various locations therebetween. Depending on the configuration, they also may include outlets in different locations relative to a user's face. For instance, air flow may be directed upward toward the face of the user, or more dispersed by providing outlets connected to the frame at locations to the sides of the user's face. With one further alternative configuration, the air flow may be still further dispersed by utilizing a tubular frame having a plurality of outlets in several positions spaced from the user's face.

In a first aspect, disclosed herein is a head garment that includes a frame having an elongated member, the frame further including a loop portion that extends upward and forward from a rear portion that includes a tail, and the loop portion includes a rim. The head garment includes a veil having a rear portion that is connected to the rear portion of the frame and a front portion that is connected to the rim. Tension in the portion of the veil that spans between the connections of the rear portion of the veil to the rear portion of the frame and the connection of the front portion of the veil to the rim provides support for the rim, and the front portion of the veil extends beyond and drapes downward from the rim.

In a second aspect, disclosed herein is a ventilation system for use with a head garment of the present disclosure. The ventilation system may be used to condition air in a privacy space around a user's face, which is defined by the draped veil.

In a third aspect, disclosed herein is a hanger for an electronic device for use with a head garment of the present disclosure. For convenience of the user, the hanger is removably connected to the frame and the electronic device is removably connected to the hanger.

In a fourth aspect, disclosed herein is a head garment that is customizable to the size and shape of a user's head and that may be folded for stowing in a container for convenient carrying or storage.

Thus, the present disclosure presents examples of head garments for privacy and rest or sleep and methods of using the same that overcome disadvantages of the prior art and may be used to safely and conveniently provide privacy and darkness for a user, that optionally may be used with a ventilation system to condition the air around the user's face, and that is easily folded and stowable.

It is to be understood that both the foregoing general description and the following detailed description are exemplary, provided for purposes of explanation only, and are not restrictive of the subject matter claimed. Further features and objects of the present disclosure will become more fully apparent in the following description of the example and from the appended claims.

BRIEF DESCRIPTION OF THE DRAWINGS

In describing the preferred example, reference is made to the accompanying drawing figures wherein like parts have like reference numerals, and wherein.

It should be understood that the drawings are not to scale. While some details and other plan and section views of the example head garments for privacy and ventilation systems are not shown, such details are considered to be within the comprehension of those skilled in the art in light of the present disclosure. Terms relating to directions, such as front, rear, right or left are used herein for convenience in providing the disclosure and are not intended to be limiting. It also should be understood that the present disclosure is not limited to the examples illustrated.

DETAILED DESCRIPTION

Figure 5:
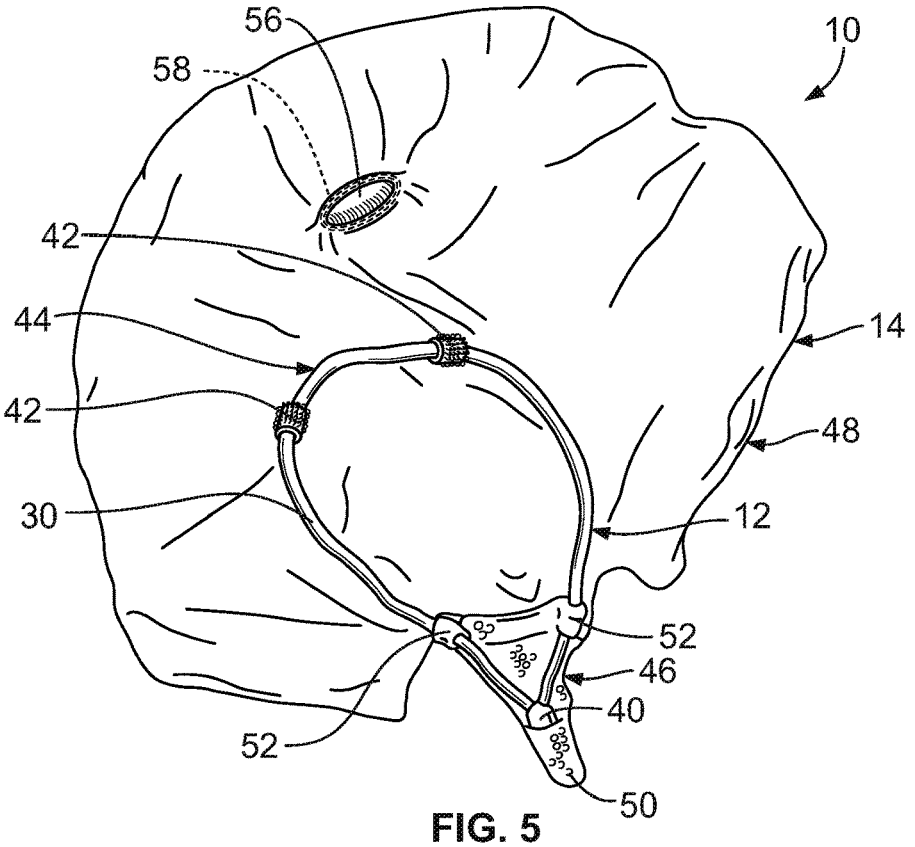
FIG. 5 is a perspective view of the example head garment of FIG. 1 showing the frame in a further step of unfolding or folding from FIG. 4 wherein the frame is further opened so as to be forming a broader generally planar loop.
Figure 6:
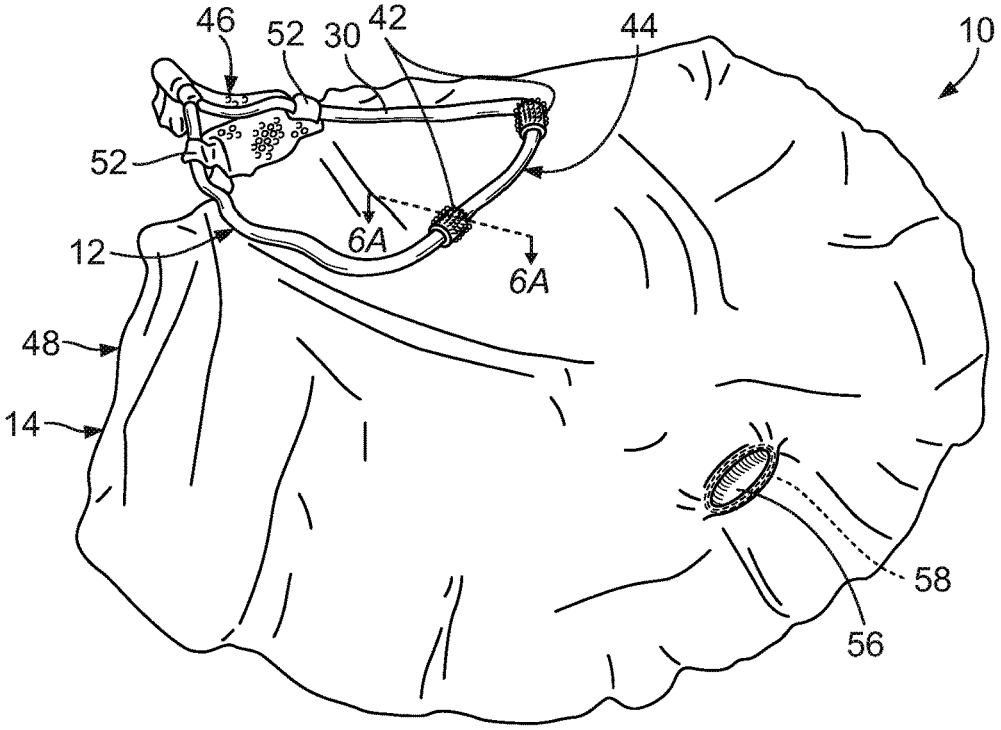
FIG. 6 is a perspective view of the example head garment of FIG. 1 showing the frame in a further step of unfolding or folding from FIG. 5 wherein the generally planar loop of the frame is bent to extend away from the prior general plane of the loop and noting a cross-section 6A-6A taken through the frame.
Figure 12A:
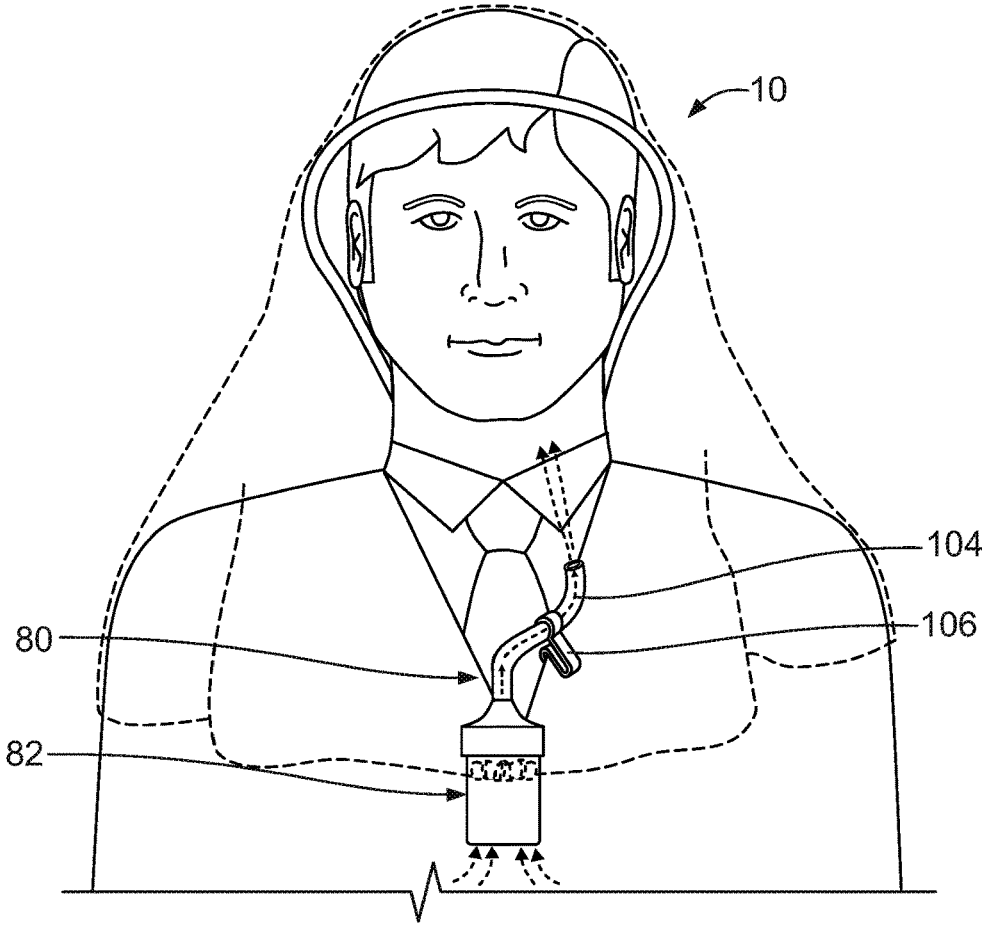
FIG. 12A is a front perspective view with most of the example head garment of FIG. 1 in phantom and being used with a first example ventilation system that is positioned on the front of the user and underneath the veil where it provides conditioned air flow directed upward to the privacy area around the user's face.
Figure 12B:
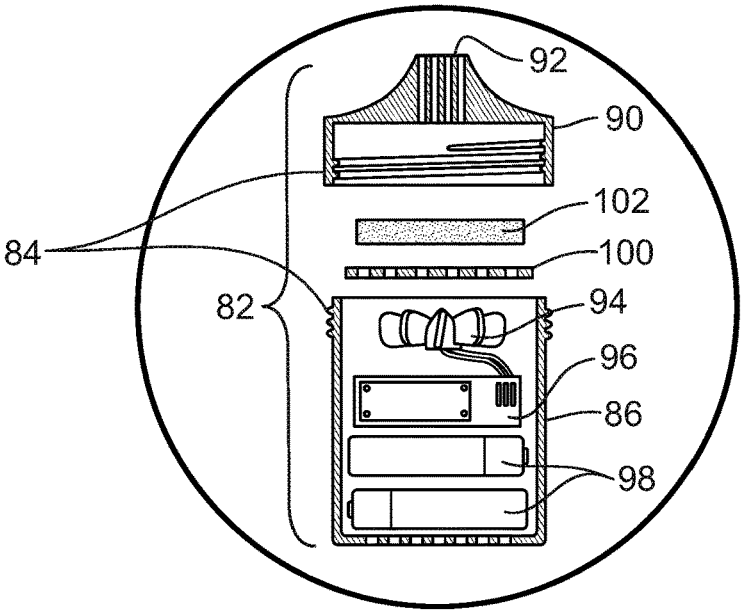
FIG. 12B is a close up partially exploded view of a fan unit of the ventilation system shown in FIG. 12A, shown with a removable insert.
Figure 13A:
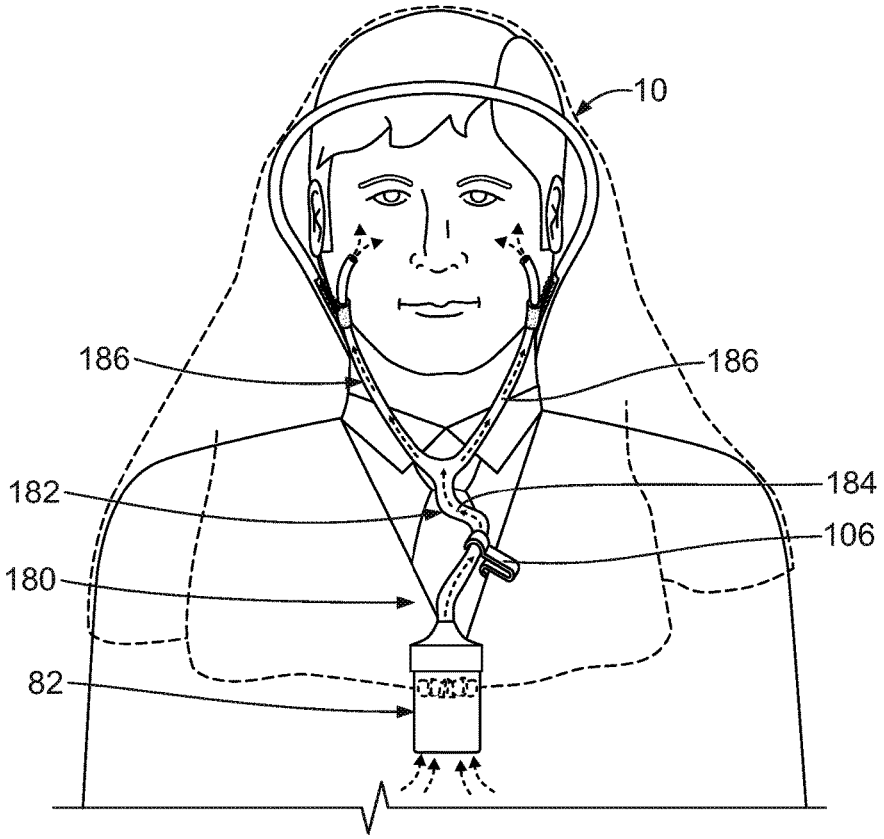
FIG. 13A is a front perspective view of a further example head garment being used with an a second example ventilation system that is positioned on the front of the user and underneath the veil where it provides conditioned air flow to the privacy area around the user's face through tubes that are connected to the frame.
Figure 14A:
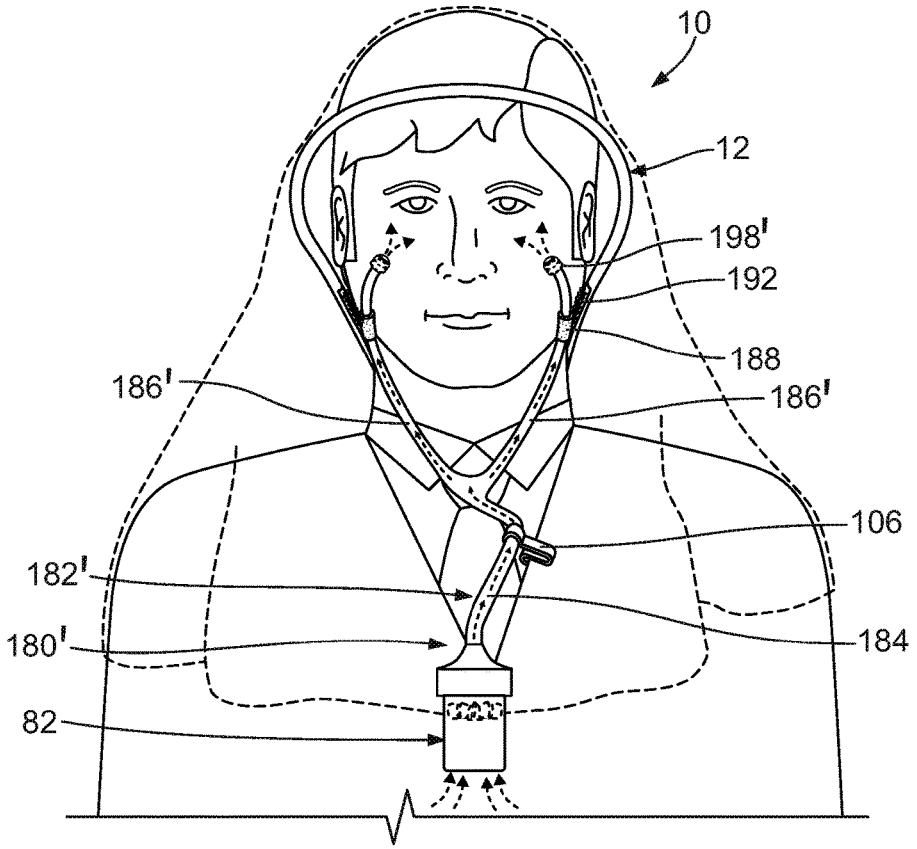
FIG. 14A is a front perspective view of the head garment of FIG. 13A being used with a third example ventilation system that is positioned on the front of the user and underneath the veil where it provides conditioned air flow to the privacy area around the user's face through tubes that are connected to the frame and that include removable inserts and caps at the ends of the tubes.

This disclosure presents example head garments for privacy and methods of using the same. For instance, a first example head garment is shown in FIGS. 1-6A and 8-10, a second example head garment is shown in FIGS. 7 and 7A, the first example head garment is shown with a first example ventilation system in FIGS. 12A and 12B, a modified example head garment is shown in FIG. 13A with a second example ventilation system and is shown in FIG. 14A with a modification to the second example ventilation system, and a further example head garment is shown with another example ventilation system in FIG. 15A.

Figure 1:
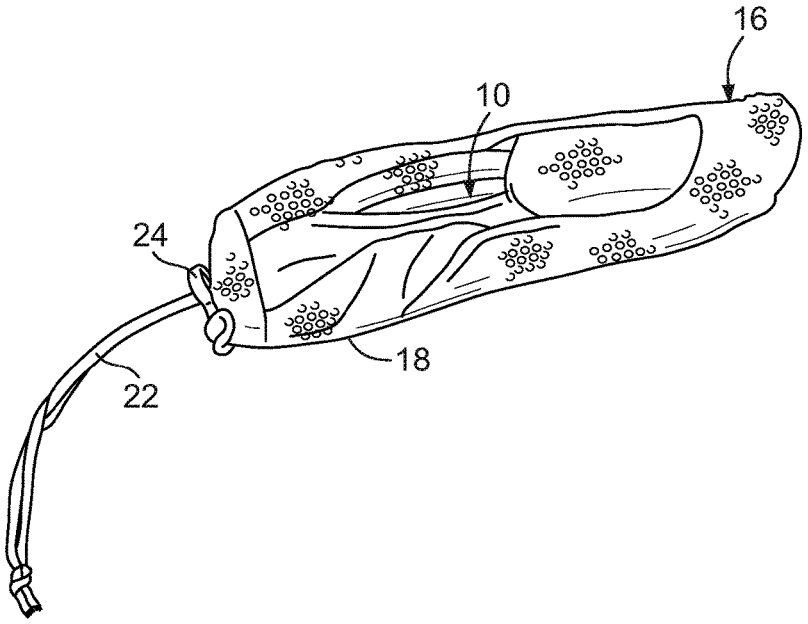
FIG. 1 is a perspective view of an example head garment folded to a stowed position and in a container.

Turning to FIGS. 1-6A and 8-10, a first example head garment 10 is shown having a frame 12 and a veil 14. An optional light weight storage container 16 in the form of a bag is provided for convenient storage and carrying of the head garment 10. The storage container or bag 16 is shown being constructed of flexible material that is configured in the form of a sleeve 18 having an opening 20 at one end and an adjustable drawstring 22. The drawstring 22 includes a clamp element 24 that may be used to selectively secure the storage container 16 in a closed position, as shown in FIG. 1. However, it will be appreciated that alternative structures for achieving releasable closure may be utilized. The flexible material of the sleeve 18 preferably is of a mesh fabric to avoid trapping moisture or odors in the head garment 10 when it folded and stowed in the bag 16 immediately after use. Nevertheless, it will be appreciated that alternative materials, such as various fabrics or plastic films, or even rigid cases optionally may be used to protect the head garment 10 when stowed.

The construction of the frame 12 of this example includes a lightweight, elongated member 30 that is formable and bendable, meaning that it will hold its form after being bent into a shape. In this example, the elongated member 30 includes a core 32 that is a rod that may be formed of metal wire, formable plastic or other suitable lightweight materials that are bendable and will hold a shape after being bent. The elongated member 30 of this example also includes a cover 34 that is bonded to the core 32 and is constructed of lightweight closed cell foam. The frame 12 of this example is shown with the elongated member 30 having an elongated cylindrical shape. However, it will be appreciated that the cover 34 may be constructed of alternative materials and in various shapes that may be other than cylindrical, and indeed, the elongated member may be constructed in various ways whether including a unitary element or an alternative combination of materials and structures. Additionally, it will be appreciated that the elongated member could be constructed in a manner to be substantially rigid, whether in a single non-bendable shape or as two or more segments that may be connected, whether in straight connections, telescopically or by one or more hinges. The frame also may include a cover, and the cover may or may not be bonded to the core of the elongated member.

The elongated member 30 of the frame 12 includes a loop portion that extends upward and forward from a rear portion that includes a tail 40. In this example, the elongated member in the rear portion is bent back on itself to bring two opposed ends 36, 38 together to form the tail 40. The two ends 36, 38 may be joined in any suitable manner to form the tail 40, such as by use of an outer wrap or tape, or by use of adhesive or a socket that may slidably receive the two ends of the elongated member 30. It will be appreciated that a tail may be formed in alternative ways, such as when the elongated member 30 is a continuous loop by bending short sections of the loop toward each other to be parallel, so as to form a tail. The tail 40 has a tendency to help maintain the positioning of the head garment 10 when in use, and allows the head garment 10 to be used without requiring that it be trapped against a seat behind the user or within a collar of a shirt, jacket, coat or the like. The tail 40 also preferably may include added ballast, which may be constructed of any suitable material to add weight to the tail 40. Ballast may be particularly useful if a user will be hanging more than a veil from the rim. Indeed, ballast that is removably connectable to the tail may be provided, so as to be able to adjust the weight of the tail, as needed.

The frame 12 additionally includes at least one connecting member 42, although the first example is shown with two connecting members 42 that are spaced apart from each other and from the tail 40, as shown in FIGS. 3-6. While there could be one longer connecting member, the spaced apart connecting members 42 are preferred for controlling the connection of the veil 14 to the elongated member 30. The connection of the veil occurs along a portion of the frame 12 that will be shaped into a rim 44 that extends outward from the user's face during use, and typically will be positioned forward of the user.

Figure 6A:
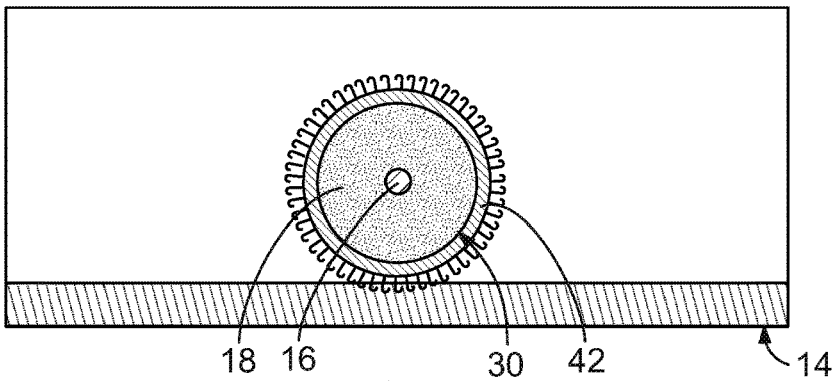
FIG. 6A is a cross-sectional view of the frame taken through 6A-6A in FIG. 6 and showing a connection to the veil.
Figure 7:
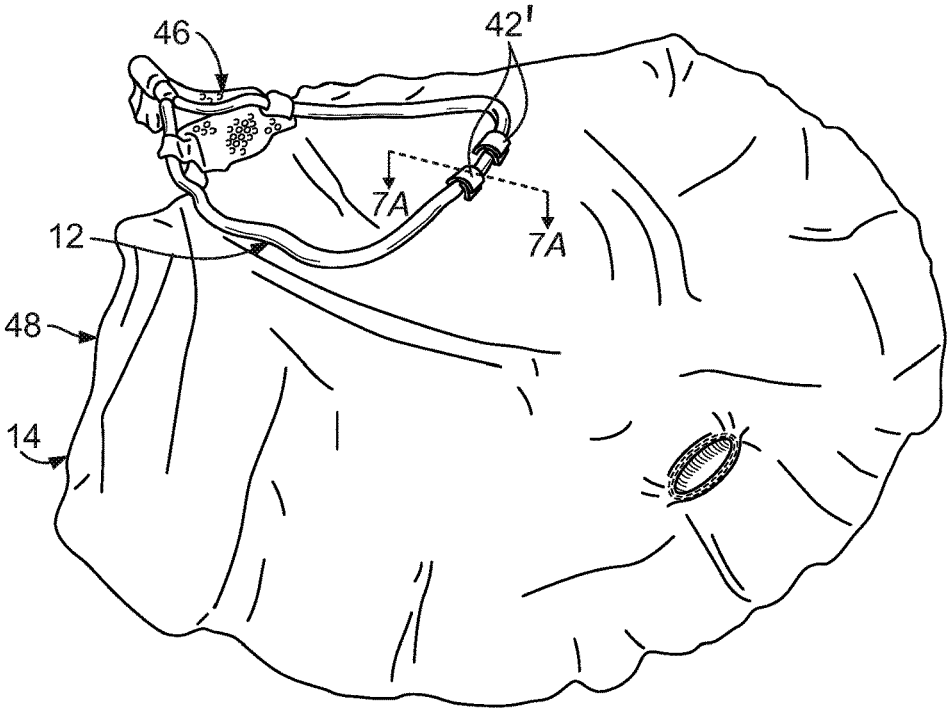
FIG. 7 is a perspective view of a further example head garment that is identical to the first example shown in FIG. 6 except with respect to the connectors between the frame and the veil and noting a cross-section 7A-7A taken through the frame.
Figure 7A:
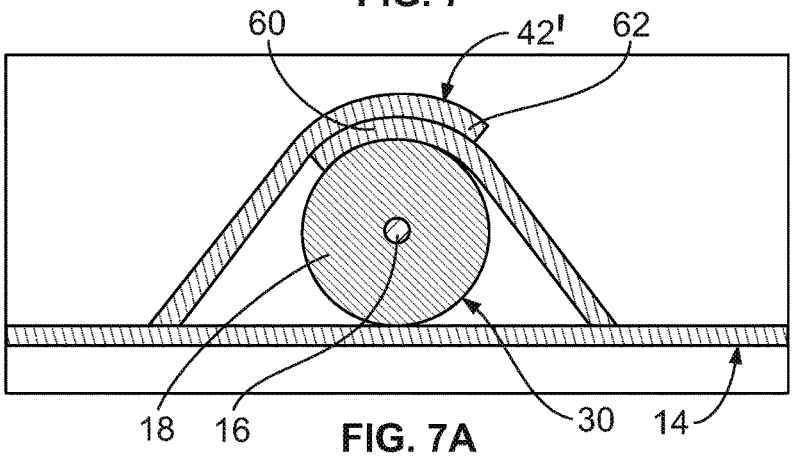
FIG. 7A is a cross-sectional view of the frame taken through 7A-7A in FIG. 7 and showing a connection to the veil.

As shown in the cross-section in FIG. 6A, a connecting member 42 may be constructed of a strip of a hook type fastener that encircles and is bonded on its rear surface to the elongated member 30, such as by adhesive or other suitable means of connection, thereby having the hook elements extending outward from the frame 12. When using two connecting members 42, they may encircle the elongated member 30 or may be formed of smaller portions that only run along a top or forward surface of the elongated member 30, and generally may be the hook portion of Velcro® hook and loop type fasteners, or may be constructed in any suitable manner that is capable of connecting the elongated member 30 to the veil 14. As will be described below, the connection provided by the connecting members 42 is intended to be repositionable, and it will be appreciated that while the hook type fasteners may provide fast and limitless adjustment, alternative connecting members could be used, such as snaps, buttons or other suitable fasteners.

The veil 12 includes a rear portion 46 and a front portion 48. The rear portion 46 is connected to the rear portion of the frame 12, such as at positions along the frame and/or at the tail 40. The front portion 48 is connected to the rim 44 and spaced from the user's face. In the present example head garment 10, the rear portion 46 of the veil 14 is shown as a lightweight perforated fabric material to avoid trapping heat from the user's head and to maximize air flow around the rear of the user's head. The front portion 48 is shown as a lightweight fabric material that is connected to and extends forward from the rear portion 46. The lightweight fabric material of the front portion 48 of the veil 14 is intended to provide a consistent shielding to the user's face, while permitting the user some visibility. It will be appreciated that the material may be constructed of various materials having unique advantages to the user.

As an example, the material of the front portion 48 or potentially the entire veil 14 may be constructed of a fabric that is 95% silk or nylon with 5% spandex or lycra. This type of fabric may provide two-way or four-way stretch, and has a weight of approximately 5-6 ounces per square yard. The fabric is light weight and does not tend to trap heat, thereby remaining quite comfortable when draped over the head of a user. If the fabric is used with the shiny side facing inward and the matte finish side facing outward, it provides an advantageous configuration that facilitates connection of the veil 14 to the connecting members 42 on the rim 44 of the frame 12 when encountering even light contact therebetween.

A black or dark blue material is preferable for the veil for creating a darkened space around the user's face, but other colors may be used. In unofficial light porosity testing at a distance of four feet from a 65 watt flood light, an individual would be subjected to 520 lux under normal conditions without use of the head garment 10, but only 5 lux when using a veil 14 that employs this type of material. This is equal to about 1% light porosity. Similarly, when seated in bright, clear overhead sun light, an individual would be subjected to 10,300 lux under normal conditions without use of the head garment 10, but only 600 lux when using a veil 14 that employs this type of material. This is equal to about 5% sun light porosity. Certainly, other materials for the rear portion 46, front portion 48 and/or the entire veil 14 may be suitable, and the need for a tendency to connect to a hook type fastener will depend on whether the connecting members utilize such fasteners that tend to grab the veil or other more direct connectors, such as overlapping hook and loop tabs, snaps, buttons or the like.

In the present example, the rear portion 46 of the veil 14 includes a sleeve 50 that receives the tail 40 and tabs 52 having a strip of loop type fastener for connection to a corresponding strip of hook type fastener that is connected to the rear portion of the frame 12 at locations spaced from the tail 40. While hook and loop type fasteners are used in this example, and three points of connection of the rear portion 46 to the frame 12 are shown, it will be appreciated that other connectors may be used and fewer or more points of connection or continuous connection may be used, if desired. The three-point connection of the present example seeks to minimize air flow restriction around the rear of the user's head, while stabilizing the rear portion 46 of the veil 14 and allowing a plurality of ways in which a user's hair may extend around or between components at the rear of the head garment 10, to enhance the comfort of the user.

In the present example, the rear and front portions 46, 48 of the veil 14 are connected to each other, such as by sewing. However, it will be appreciated that the rear and front portions may be constructed as a unitary piece of material, or if constructed as separate pieces, they may be releasably connected to each other, such as by use of hook and loop fasteners, snaps, buttons, a zipper or other suitable means of connection.

Figure 2:
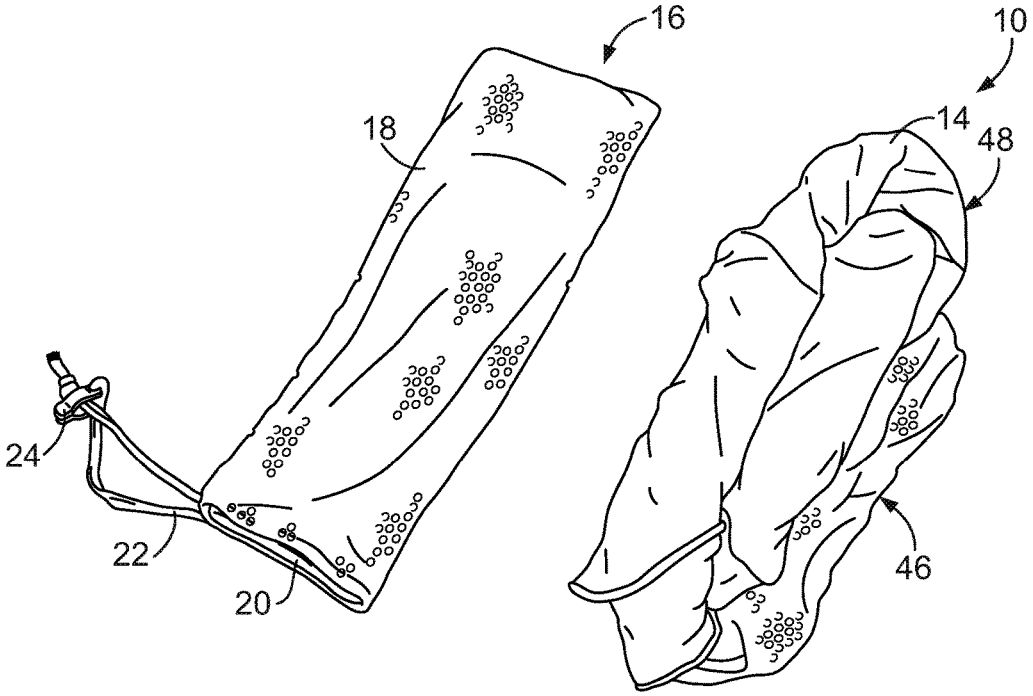
FIG. 2 is a perspective view of the example head garment and container of FIG. 1, with the folded head garment removed from the container and still being in the folded, stowed position.
Figure 3:
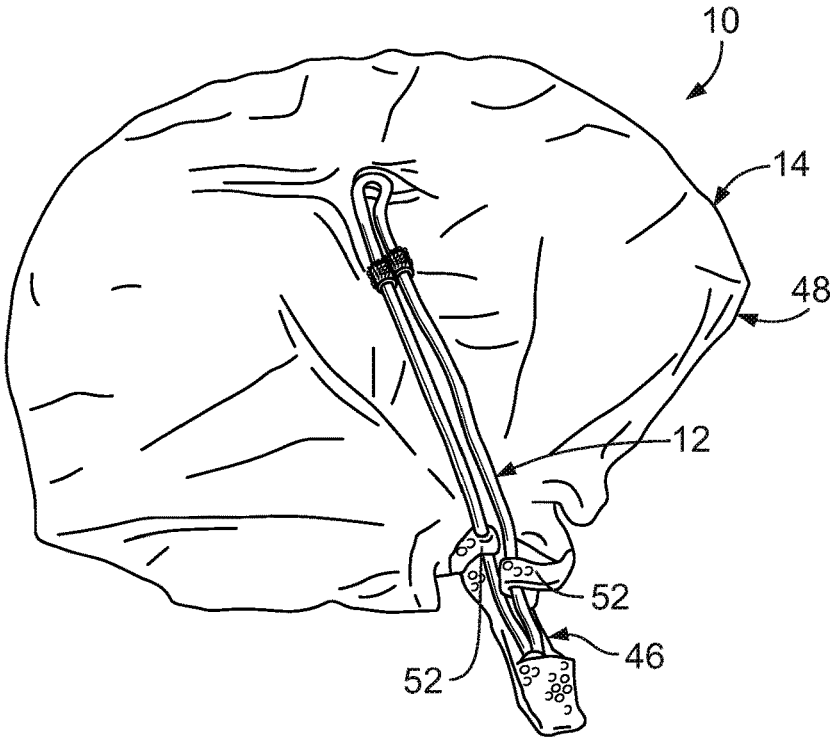
FIG. 3 is a perspective view of the example head garment of FIG. 1 showing the frame after a first step of unfolding, or in one of the last steps of folding the head garment to the stowed position shown in FIG. 2, with the frame in a straightened position overlying a veil that is unfolded and extended outward on a planar surface.

With the first example, various steps between a stowed position and deployment of the head garment 10 are shown in FIGS. 1-6 and 8. In FIG. 1, the head garment 10 is shown in a stowed position within the storage container 16. To achieve the folded position for stowing within the container 16, the veil 14 is gathered around the frame 12 and the frame is bent back on itself to create the compact folded position shown in FIG. 2. This is achieved by first shaping the elongated member 30 of the frame 12, which in this example is formable and bendable, as shown in FIG. 3. Then, the frame 12 is rolled parallel to its long axis, to roll or gather the veil 14 adjacent the frame 12. The frame 12 is then twice folded, to reduce the length and to place the head garment in the position shown in FIG. 2. In such a compact position, a user may slide the folded head garment 10 through the opening 20 and into the container 16, and then close the container 16 to reach the stowed position in FIG. 1.

Figure 4:
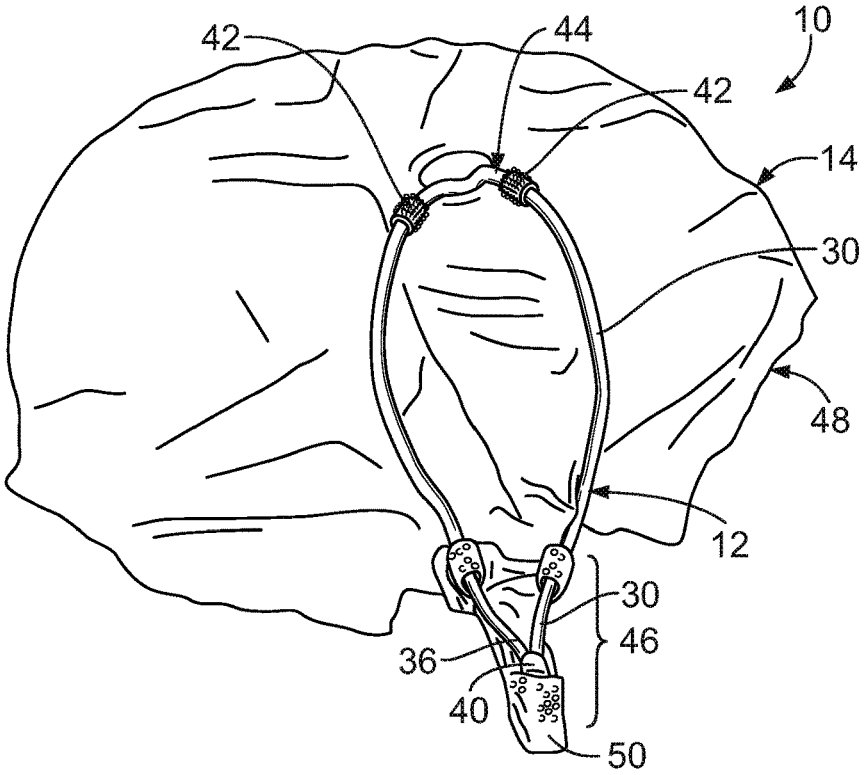
FIG. 4 is a perspective view of the example head garment of FIG. 1 showing the frame in a further step of unfolding or folding from FIG. 3, wherein the frame is being opened so as to be forming a generally planar loop.
Figure 9:
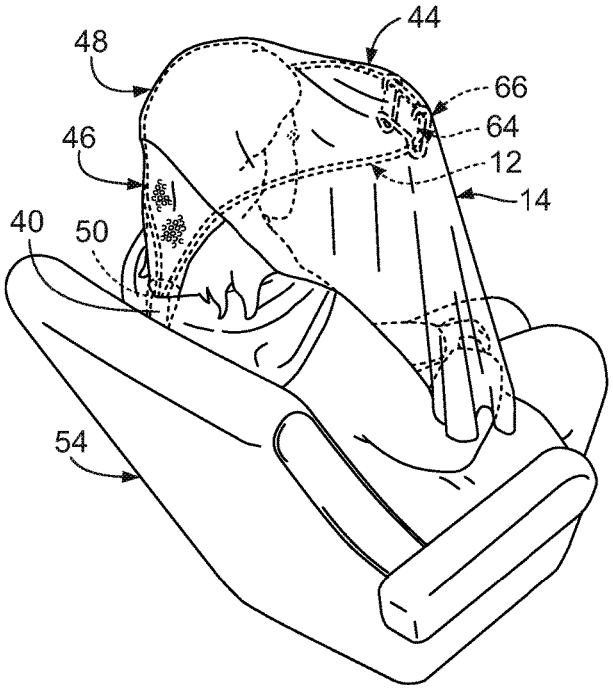
FIG. 9 is a rear perspective view of the example head garment of FIG. 1 on the user in FIG. 8, but also including use of an electronic audio-visual device that is removably connected to the frame of the head garment.
Figure 9A:
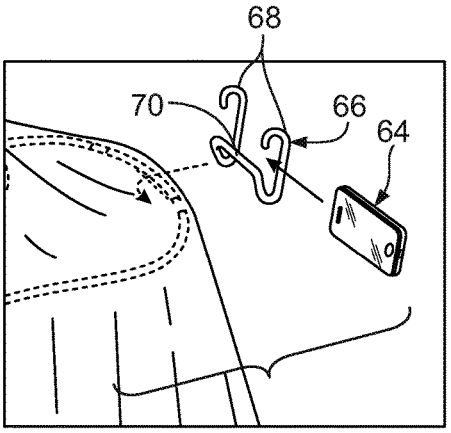
FIG. 9A is a close up partially exploded view of a hanger that connects to the head garment and holds the audio-visual device shown in FIG. 9.
Figure 11:
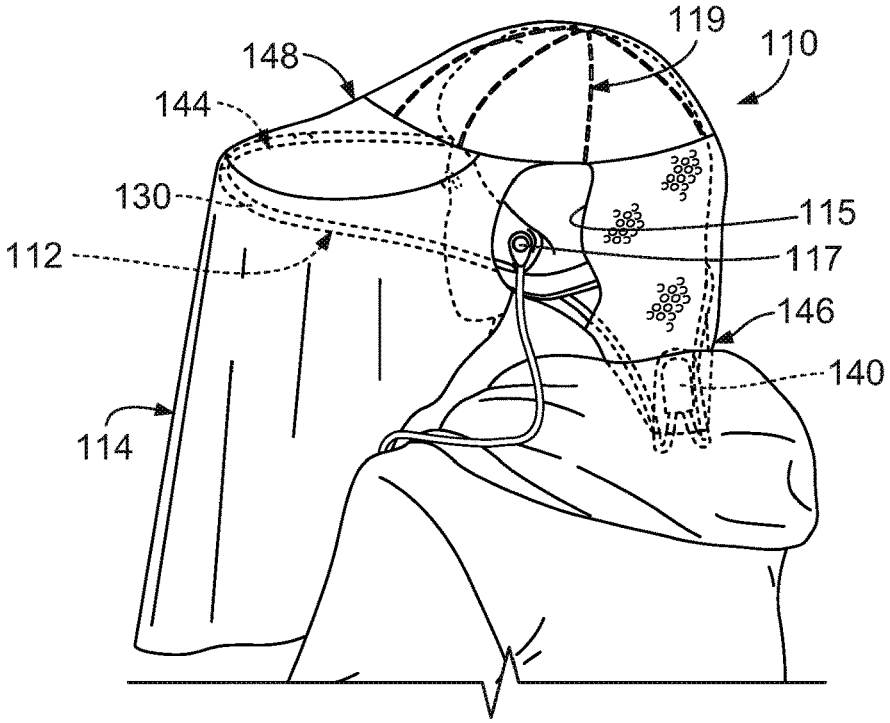
FIG. 11 is a rear perspective view of a further example head garment on a user showing a veil styled generally to have the style of a baseball cap, with the tail of the rear portion of the frame bent upward and the user wearing headphones.

With the clamp 24 released, the drawstring 22 may slide through the clamp 24 to expand the opening 20. The folded head garment 10 then may be removed from the container 16, as is shown in FIG. 2. Once removed, the head garment 10 may be unrolled, to expose the frame 12 and the veil 14, as shown in FIG. 3. The user then may conveniently manipulate the elongated member 30 of the frame 12 to begin to shape the frame 12 into a loop portion, as shown in FIG. 4. The user may continue to shape the frame 12 to have a rear portion and a loop portion that includes a front rim 44, as shown in FIG. 5 in a generally planar orientation. The loop portion of the frame 12 then may be bent from a generally planar orientation to a curved shape, as desired and as shown in FIG. 6. During use, the curved shape will allow the tail 40 to be located at the nape of the neck of a user, whether bent to extend downward, as shown in FIG. 9 or upward as shown in FIG. 11, while the loop portion of the frame 12 will extend upward and forward from the rear portion of the frame that includes the tail, and the loop portion preferably will pass by the sides of the user's head. Alternatively, the frame may be constructed so as to be substantially rigid, and may stay in a fixed configuration or be foldable, such as if constructed of segments that may be hinged, telescopically or otherwise connected, a previously mentioned.

Figure 8:
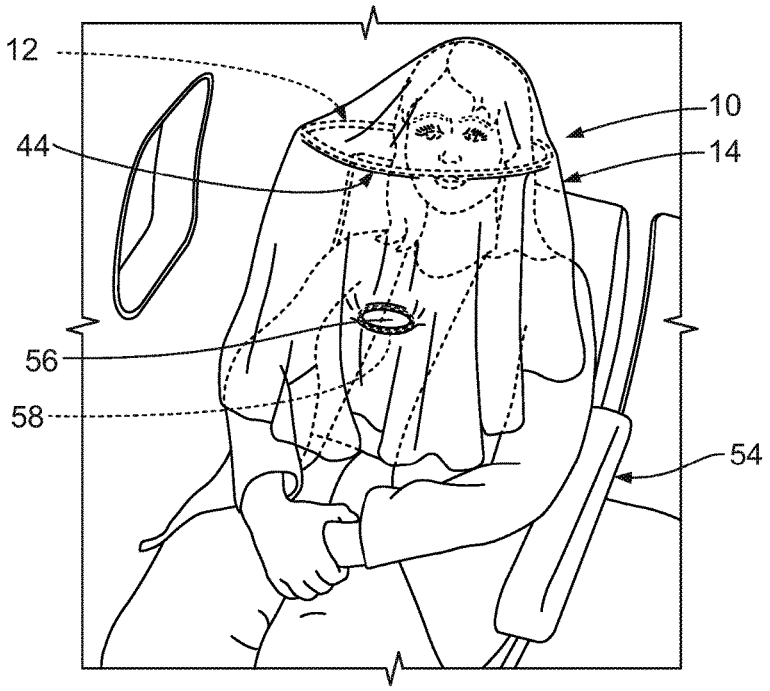
FIG. 8 is a front perspective view of the example head garment of FIG. 1 on a seated user.
Figure 10:
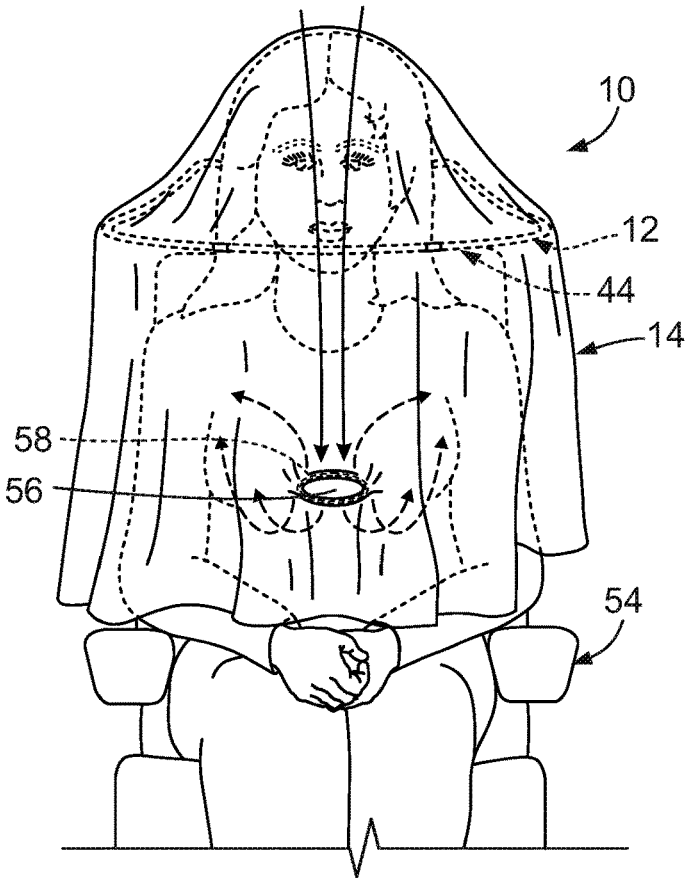
FIG. 10 is a front perspective view of the example head garment of FIG. 1 on the user in FIG. 8 and showing the flow of air from an overhead nozzle, such as is provided in an airplane, train, bus or car to an aperture for ventilation.

With the frame 12 configured for use, the user may invert and don the head garment 10, as shown in FIGS. 8-10. In this example, when in position for use, the tail 40 within the sleeve 50 of the rear portion 46 of the veil 14 is positioned rearward and may extend generally downward adjacent the nape of the neck of the user. As noted previously, the tail 40 alternatively may be bent upward and extend adjacent the nape of the neck of the user, as shown in FIG. 11. If the user is wearing a shirt, jacket, coat or the like, having a collar, the tail 40 and sleeve 50 may be tucked into such a garment to provide further stability to the head garment 10. The frame 12 then extends upward and forward from the rear portion that includes the tail 40, so as to be spaced from the sides of the user's head and to locate the rim 44 generally forward of the user's face. The front portion 48 extends forward from the rear portion 46 of the veil 14 and is permitted to drape downward from the rim 44. As the veil 14 passes over the frame 12, the hook type portions of the connectors 42 tend to grab the fabric of the veil 14 and establish a releasable or repositionable connection between the frame 12 and the veil 14.

With this example frame and veil structure, the veil 14 serves as a drape or shield of the head garment 10 as it hangs from the frame 12. However, importantly, the veil 14 also plays an integral structural role by serving as a tension element in the portion of the veil that spans between the connection of the rear portion 46 of the veil 14 to the rear of the frame and the connection of the front portion 48 of the veil 14 to the rim 44, via the connectors 42. The sewn pattern of the fabric of the veil 14 is designed to have the tension generated by the pulling downward of the forward rim 44 be aligned by fabric shape to be directed back through the veil 14 to the tail 40 at the nape of the neck. This allows the fabric pattern to incorporate the engineering to support the device in whatever position is desired by the user, including from prone to upright seated positions, and from side to side. It should be noted that when a user is lying to one side, such as when napping, the frame is comfortable to lie on and is bendable to the upside to form a private, dark space not touching the face.

Thus, when in use, the head garment 10 comprises a tensile structure with the veil 14 starting at an anchoring point at a rear portion of the frame 12, such as at the tail 40, and extending upward and forward, such as past the sides of the head of the user, wherein any part of the underside of the veil 14 that lightly contacts the connectors 42 on the rim 44 will become connected by the hook portions of the connectors 42 and the veil 14 will help to support and position the rim 44 of the frame 12 in front of the user. This, in turn, permits a further portion of the front portion 48 of the veil 14 to hang or drape downward via gravity from the rim 44 of the frame 12 and shield the user's face. If the veil 14 did not connect to the frame 12 in the area of the front portion 48, then the weight of the veil 14 would put downward pressure on the rim 44 and cause the lightweight frame 12 to sag or droop downward in front of the user's face. With the connectors 42 being at least releasably connected to the veil 14, the tension in the veil 14 as it stretches over the top of the head of the user suspends the frame 12 in its position for use. The user can therefore adjust the rim 44 forward or backward, or higher or lower, or even from one side to the other. With any part of the underside of the fabric veil 14 lightly gripping the hooks of the connectors 42, there will be tension that helps position and support the rim 44 and hold the veil 14 off the face, in almost any position. The connectors 42 may be of any of the aforementioned configurations and may be repositionable, such as when using hook type fasteners by use of self-stick patches of the hook type fastener or the like, to be placed or replaced anywhere on the rim to accommodate the user's head position. For instance, when in the prone position and lying on a side, the user may adjust the connectors to the upward side of the rim to have the tension developed as the veil extends over the side of the head, so as to keep the veil away from the user's face.

It will be appreciated that the veil 14 may be quickly and easily separated from the connectors 42 on the rim 44 of the frame 12 and repositioned, so as to adjust the angle at which the frame 12 is suspended. In this manner, with the elongated member 30 serving as the backbone of the frame 12 and the ability to connect the veil 14 at any position as it passes over and drapes from the frame 12, it will be appreciated that the head garment 10 may be considered to be a one-size-fits-all device. Thus, the user is able to customize the shape and location of the frame 12, and therefore, the space enclosed by the veil 14 relative to the user's face. Indeed, the elongated member 30 may be bent to the user's preference in terms of distance from face, angle away from the face and for the width and depth of face or head size.

The head garment 10 is shown in use from various angles in FIGS. 8-10 and in a suitable environment, such as donned by a user that is a passenger in a seat 54 of an airplane, bus, train or car. The veil 14 optionally may include one or more apertures 56 to improve air flow into and/or out of, as well as around privacy space created by the head garment 10. The veil 14 may include a formable eyelet 58 surrounding such an aperture 56, which allows the aperture to be shaped, such as in a scoop shape to capture air flowing in a particular direction, such as downward. This is shown, for example, in FIG. 10 where the user is wearing a head garment 10 and has directed downward toward the front of the draped veil 14 an air nozzle, such as may be located in an overhead structure of a passenger compartment of an airplane. The air flowing directly downward from the air nozzle will tend to flow through the aperture 56 and disperse within the privacy area within the confines of the veil 14. Alternatively, the formable eyelet 58 would allow the user to close the aperture 56, or additional apertures may be provided and formed to permit cross ventilation or other desired patterns of air flow. This may be important and enhance the comfort of the user.

Also, the air in airplanes has a tendency to be quite dry, but with use of a head garment 10 of the present disclosure, a user may be able to retain a greater level of humidity in the privacy area in front of the user's face. Thus, the humidity level may increase as the humidity of the user's breadth may not be as easily dispersed as if the user was not wearing a head garment 10 and the user's face was open to the ambient air. The increase in humidity around the face may prevent dry skin that can cause wrinkling. The humidity also can be adjusted within the privacy space by closing and/or adjusting the apertures 56 relative to the level of containment necessary for the moisture of the user's exhalation. In addition, a slight buildup or coating of moisture on the fabric of the veil 14 may be advantageous to trap microbes at the veil 14, preventing the microbes access to the eyes, mouth and nose orifices. This may be true particularly if the fabric material for the veil 14 advantageously includes silver elements, which are known to provide antimicrobial and some antiviral effects.

Turning to FIGS. 7 and 7A, an alternative configuration having connectors 42' is illustrated, with the remainder of the head garment 10 being the same as with respect to the first example. In this example, it will be appreciated that, instead of having connectors 42 on the frame 12 to grab or connect to the underside of the veil 14 at any points along the veil, the connectors 42' are constructed as a pair of complementary hook and loop type fastener tabs 60, 62. As shown in FIGS. 7 and 7A, the tabs 60, 62 each are connected at a first end to the veil 14, such as by sewing, and are free at an opposed second end to capture the frame 12 and be lapped over each other to establish a connection to each other and to the frame 12. It will be appreciated that connectors of this configuration may be more limiting with respect to the freedom to adjust the position of the frame 12 and veil 14 in front of the user, however, the spacing from the face to the rim 44 could still be adjusted by virtue of the shape chosen for the segments of the frame that extend from the tail to the rim 44. Thus, a wide loop would place the rim 44 and draped veil 14 closer to the face of the user, while a narrower and elongated loop of the frame 12 would permit the user to space the rim 44 and draped veil further from the user's face. It also will be appreciated that further alternative constructions for the connectors 42 or 42' may be used, depending on the desired convenience and adjustability for repositioning the frame 12 and veil 14.

The head garment 10 also may be advantageously used with an electronic device 64 that may removably hang from the frame 12. As shown in FIG. 9, a hanger 66 may be removably connected to the frame 12, such as forward of the user, at the rim 44. In this example, the hanger 66 is shown as plastic coated, formed rod or wire that includes two hook portions 68 that connect to the rim 44 in two places for stability, and a holder 70 that allows an electronic device 64 to be cradled and removably held in place on the hanger 66. It will be appreciated that the electronic device 64 may be an audio, visual or audio-visual device. Also, if the electronic device 64 provides audio, the user may listen to the device from one or more speakers on the device or via headphones. The device may be a smart phone or other device and may be used for entertainment, communication or other purposes. The darkened environment beneath the veil 14 would provide a unique viewing experience, free of the typical menacing glare due to overhead lights or sunlight. It also will be appreciated that the hanger may be constructed in other configurations and of other suitable materials, as desired, so as to be able to connect the hanger to the frame and the electronic device to the hanger.

Turning now to FIG. 11, another example head garment is shown. In this instance, an example head garment 110 is quite similar to the head garment 10 of the first example, and includes a frame 112 having an elongated member 130, and a veil 114. The frame 112 has loop portion that extends upward and forward from a rear portion that has a tail 140, with the tail 140 being bent upward to lie adjacent the nape of the user's neck. The loop portion includes a forward rim 144. While the head garment 110 operates in a similar manner by using the tension in the veil 114 that spans between a connection of a rear portion of the veil to the rear portion of the frame and a front portion of the veil that is connected to the rim, this example presents certain differences in construction.

The head garment 110 differs with respect to the construction of the veil 114 along the side of the user's head and the inclusion of indicia on the top of the veil 114 when in use. More particularly, the side of the veil 114 includes an aperture 115 that is formed where a rear portion 146 meets a front portion 148 because the front and rear portions are not connected or sewn to each other continuously along their margins. The aperture 115 provides access to the user's ears, in the event the user may wish to use earphones 117 or adjust a pair of eye glasses. Indicia 119 on the top of the veil 114 is illustrated as a fanciful design that may be applied by stitching and simulates a baseball cap. It will be appreciated that indicia may be applied in many ways, whether intended to be permanently affixed to the veil 114 or readily removable. Such indicia also may provide decorations or may be applied in the form of permanent or removable messages, such as, for example, "Please do not disturb." In this manner, the head garment 10 may permit an individual to avoid small talk when wanting to sleep or to provide a message that may help to project a desire to reduce the noise level in the immediate area.

The disclosure includes examples of ventilation systems that may be particularly useful with the example head garments disclosed herein. For instance, FIGS. 12A and 12B show a ventilation system 80 for use with a simplified view of the first example head garment 10. The ventilation system 80 includes an air flow device 82 shown in a simplified manner for convenience and as including a housing 84 that has a body 86 having an inlet 88 and a removable cap 90, which defines an outlet 92. As shown in FIG. 12B, the housing 84 is fitted with a fan 94, a controller 96 and batteries 98 to provide a power source for the air flow device 82. The housing 84 optionally includes a compartment that is defined by the underside of the removable cap 90 and a perforated plate 100.

The compartment may house one or more inserts 102, such as a filter made of a fibrous or other material. The inserts also may include one or more pads or other structures that may serve one or more different purposes. For instance, an insert may be soaked in water, to help produce humidity, or in a scented and/or medicinal substance, so as to provide aroma therapy, which may promote sleeping or general sense of wellbeing. An insert may include a substance that generates heat, as may be used in hand warmer packets, or that promotes cooling, as may be used in cold first aid packs. There may be compartments that hold inserts at various locations within the ventilations system ranging from at an inlet, to at an outlet and to anywhere therebetween. A user may select any combination of inserts to gain the desired conditioning of the air, and as may be appropriate for the environment in which the head garment will be used. The inserts also may be configured to be disposable or reusable, as desired.

As shown in FIG. 12A, the air flow device 82 further includes a tube 104 connected to the housing 84 at the outlet 92, and a removable fastener 106 that is connected to the tube 104. The removable fastener 106 is in the form of a clip that may be connected to the user's clothing, such as is shown with the clip being connected to the lapel of the user's jacket. The air flow device 82 is intended to be of very light construction, and therefore, the fan 94 may be a micro fan or nano fan, with suitable batteries 98, preferably being rechargeable. Accordingly, the air flow device 82 may hang from the user's clothing by a single fastener, but if necessary additional or alternative means of connection may be provided. As will be appreciated, it may be preferable to place a filter at the inlet 88 to the housing 84, such as by placing a filter insert in the housing below the batteries 98, controller 96 and fan 94. It also would be preferable to place any inserts that include moisture, whether to increase humidity or to provide aroma therapy downstream of the fan 94 and other components, so as to minimize the degree to which such inserts may leave residue on the components in the housing. It will be understood that the tube 104 may be constructed of suitable materials, may be of suitable diameter and length, and may be formable to help direct the conditioned air, or may utilize an outlet nozzle to disperse the conditioned air within the privacy space around the user's face, as defined by the draped veil, as desired. Finally, the fan in the ventilation system could be operated in reverse in any of the examples herein, so as to exhaust air from around the user's face.

Figure 13B:
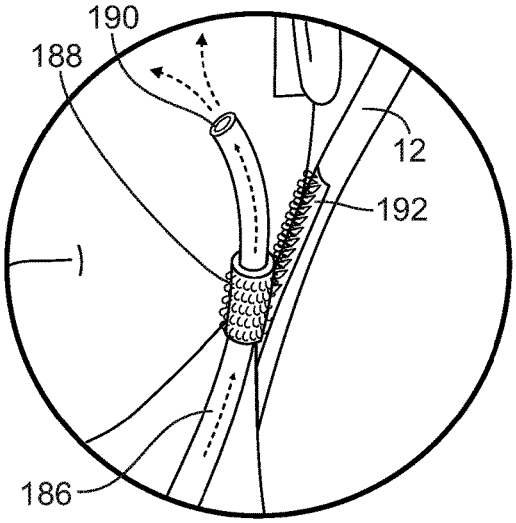
FIG. 13B is a close up perspective view of an end of a tube of the example ventilation system shown in FIG. 13A connected to the frame.
Figure 13C:
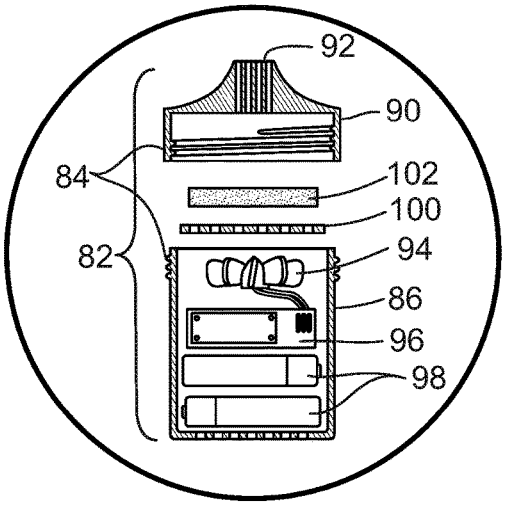
FIG. 13C is a close up partial cross-sectional view of a fan unit of the example ventilation system shown in FIG. 13A, shown with a removable insert.

A further example ventilation system 180 is shown in FIGS. 13A-13C, which includes a modified version of the ventilation system 80 and modified version of the head garment 10. The ventilation system 180 shares the same components of the air flow device 82 shown in FIG. 12B and will, therefore, utilize the same reference numerals and rely on the prior description thereof. However, as shown in FIG. 13A, the ventilation system 180 includes a tubing system 182 that has a single tube 184 that connects to the outlet 92 of the air flow device 82 and extends past the fastener 106 for connection to the user's clothing, and which further branches into a plurality of tubes that are shown in this example as two tubes 186.

The tubes 186 include a connector 188 near their distal ends 190, which is shown for example as a loop portion of a hook and loop type fastener, where the opposed hook portion 192 is connected to the frame 12 along the spans that pass the sides of the user's head. With this configuration, the conditioned air is provided from at least two tubes 186 that are connected to the frame 12 to allow the air to be dispersed near the sides of the user's face and the tubes 186 may be directed in any preferred direction at their connection to the frame 12.

Figure 14B:
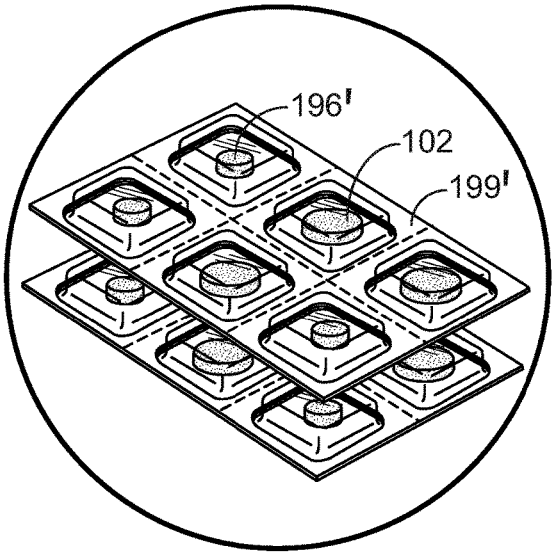
FIG. 14B is a perspective view of a pair of blister packs which may contain the inserts used in the fan unit shown in FIGS. 12B and 13C and in ends of the tubes in FIG. 14A.
Figure 14C:
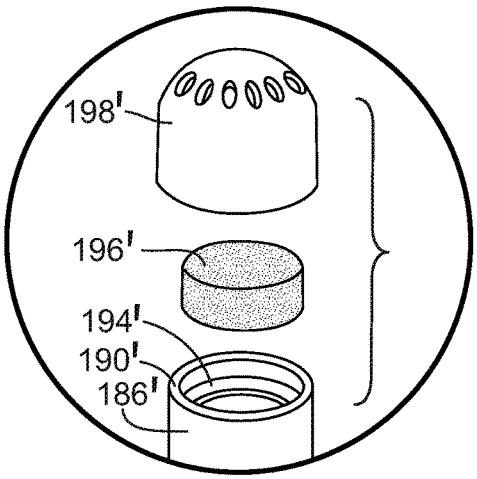
FIG. 14C is a close up exploded perspective view of an end of a tube of the example shown in FIG. 14A showing an insert and a cap at the end of a tube that would be connected to the frame.

Another example ventilation system 180' is shown in FIGS. 14A and 14C, along with a package of inserts in FIG. 14B. The ventilation system shown in FIG. 14A includes a modified version of the ventilation system 180 of the immediately prior example, and therefore, will receive similar numbering and will rely on the prior description for the shared components. Thus, the ventilation system 180' includes an air flow device 82 and a tubing system 182' that has a single tube 184 that connects to the outlet 92 of the air flow device 82 and extends past the fastener 106 for connection to the user's clothing, and which further branches into a plurality of tubes that are shown in this example as two tubes 186'.

The two tubes 186' include a connector 188 near their distal ends 190, as described above with respect to the prior example. However, in this example, there are compartments that may hold inserts, where as shown in FIG. 14C, the compartments are formed at the distal ends 190' of the tubes 186', which include an internal ledge 194' on which an insert 196' may rest, and are further defined by the underside of caps 198' that are removably connected to the ends 190', such as by press fit or other suitable means of connection. The caps 198' are perforated to permit air flow, while also covering and retaining inserts 196'. The inserts 196' may include similar materials and uses as the previously described inserts 102. Moreover, both types of inserts 102, 196' may be provided in sealed packaging, such as a blister pack 199' seen in FIG. 14B or other suitable packaging, so as to retain moisture and freshness, or to permit use of materials that react when exposed to air. Accordingly, a user may conveniently carry a variety of inserts 102, 196' within suitable packaging from which the inserts are readily removable for immediate use by insertion into one or more compartments within a ventilation system.

Figure 15A:
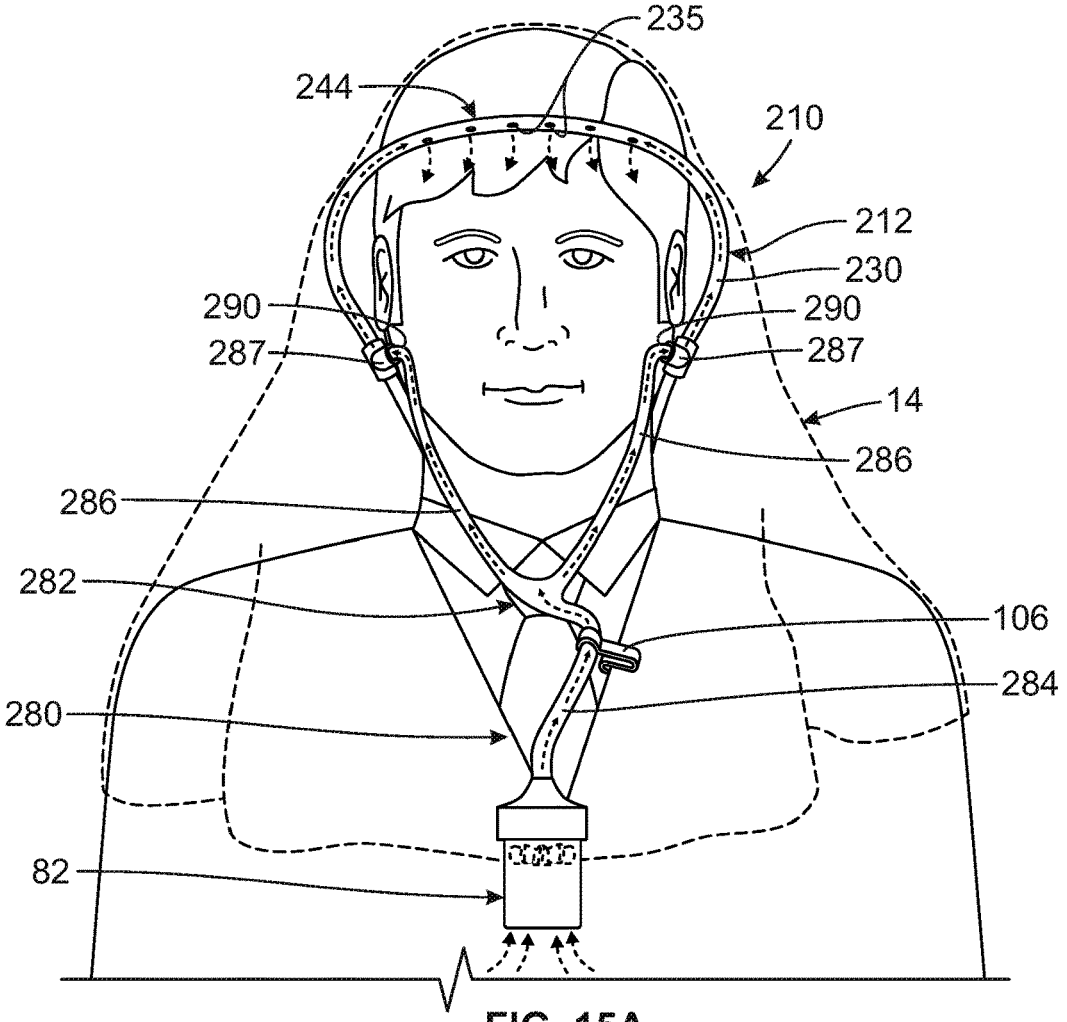
FIG. 15A is a front perspective view of a further example head garment being used with a fourth example ventilation system that is positioned on the front of the user and underneath the veil where it provides conditioned air flow to the privacy area around the user's face through tubes that are connected to a tubular frame having outlets at the front of the frame.
Figure 15B:
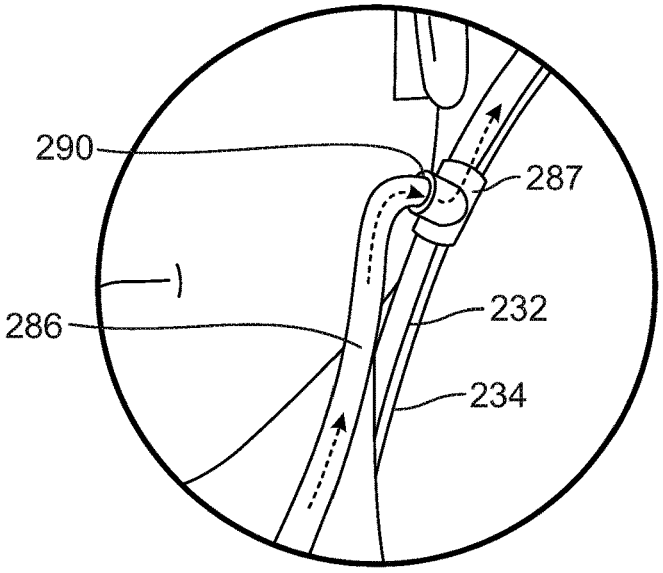
FIG. 15B is a close up perspective view of the removable connection of a tube of the ventilation system of FIG. 15A to the tubular fame.

One further example head garment 210 is shown in FIGS. 15A and 15B, with a further example ventilation system 280. The head garment 210 includes modifications in the frame 212, but uses the same veil 14, while the ventilation system 280 includes modifications in the tubing system 282, but uses the same air flow device 82. Accordingly, the prior numbering and descriptions will be incorporated herein for the common components and this description will focus on the modifications.

The frame 212 of the head garment 210 includes an elongated member 230 that includes a core 232 that is a rod that may be formed of metal wire or other suitable lightweight materials that are bendable and will hold a shape after being bent. The elongated member 230 of this example also includes a cover 234 that in this example is a plastic tube that is not bonded to the core 232, but could be if desired. The frame 212 of this example is shown with the elongated member 230 having an elongated cylindrical shape. However, it will be appreciated that the cover 234 may be constructed of alternative materials and in various shapes that may be other than cylindrical, and indeed, the elongated member may be constructed in various ways whether including a unitary element or an alternative combination of materials and structures.

The cover 234 in the form of a tube in this example is configured to play a more integrated role in the ventilation system. For example, the cover 234 includes T-fittings 287 along its sides to permit fluid connection to the ends 290 of tubes 286 that extend upward from the air flow device 82, while also including a plurality of spaced apart outlets 235 that are shown for example as opening downward from a front rim 244 of the elongated member 230. Thus, in this example single tube 284 connects to the outlet 92 of the air flow device 82 and extends past the fastener 106 for connection to the user's clothing, and further branches into a plurality of tubes that are shown in this example as two tubes 286.

The two tubes 286 include distal ends 290 that may be plugged into the T-fittings 287. In this example, inserts 102 may be used within the air flow device 82, as described above and as desired. Similarly, such inserts may be provided within sealed packaging that is convenient to carry and to open, for access to the desired inserts for use in the ventilation system 280. It will be appreciated that the head garment 210 may be folded and stowed in a manner very similar to the head garment 10 of the first example, and the container 16 may be used for the head garment 210, or a suitably larger container may be used for any of the examples that may be used with a ventilation system, as well as to facilitate carrying prepackaged inserts for use therewith.

In light of the above discussion, the drawings and the attached claims, it will be appreciated that head garments and methods of using them to provide privacy for a user in accordance with the present disclosure may be provided in various configurations. A variety of suitable materials of construction and alternatives with respect to dimensions, shapes and other attributes, as well as other methods of applying head garments may be utilized to meet the particular needs and requirements of a user. It will be apparent to those skilled in the art that various modifications can be made in the design and construction of such head garments, and in the performance of such methods, without departing from the scope of the attached claims, and that the claims are not limited to the preferred examples illustrated.

I claim:

1. A head garment comprising:

a frame comprising an elongated member;

the elongated member further comprising a loop portion including a rim that extends forward from a rear portion of the frame to a position defined at least by an extent to which the rim is spaced forward of the rear portion of the frame;

the rim being selectively bendable to retain different positions defined at least by different extents to which the rim is spaced forward of the rear portion of the frame, and by at least one folded stowed position;

a veil comprising a rear portion that is connected to the rear portion of the frame, and a front portion extending forward from the rear portion of the veil and over the rim wherein the veil is releasably connected to the rim and drapes downward from the rim defining an interior space within the veil, and wherein tension in the veil between the connection of the rear portion of the veil to the rear portion of the frame and the releasable connection of the front portion of the veil to the rim provides support for and positioning of the loop portion of the rim; and an electrically-powered fan, the fan including a fastener configured to mount the fan within the interior space to a remainder of the head garment or to clothing worn by a user of the head garment.

2. The head garment of claim 1 further comprising releasable connectors that connect an underside of the veil to an upper surface of the rim.

3. The head garment of claim 2 wherein the releasable connectors are affixed to the frame along the rim, to the underside of the veil or to both the frame along the rim and to the underside of the veil.

4. The head garment of claim 2 wherein the releasable connectors provide repositionable gripping of the underside of the veil where the veil contacts and passes over the releasable connectors on the rim.

5. The head garment of claim 1 wherein the elongated member of the frame includes a core wherein different areas below the loop portion can be formed by bending the elongated member into different shapes.

6. The head garment of claim 1 wherein an outer surface of the elongated member further comprises foam.

7. The head garment of claim 1 wherein the elongated member further comprises a tube.

8. The head garment of claim 1 further comprising a ventilation system that includes the fan.

9. The head garment of claim 8 wherein the ventilation system further comprises a filter or pad, and the ventilation system is configured to force air to interact with the filter or pad.

10. The head garment of claim 9 wherein the filter or pad is scented.

11. The head garment of claim 9 wherein the filter or pad is configured to increase humidity in the interior space.

12. The head garment of claim 8 wherein the ventilation system further comprises at least one tube that extends from a housing that is configured to hold the fan and is releasably connected to the frame.

13. The head garment of claim 12 wherein the at least one tube is releasably fluidly connected to the elongated member of the frame and the elongated member includes a plurality of outlets.

14. The head garment of claim 1 further comprising a container that is configured to receive the head garment in the at least one folded stowed position.

15. The head garment of claim 1 wherein the head garment is configured to support an additional electronic device along an underside of the veil for operation in the interior space.

16. The head garment of claim 15 further comprising a hanger by which the head garment is configured to support the additional electronic device and wherein the hanger is removably connected to the frame.

17. The head garment of claim 16 wherein the hanger is configured to releasably hold the additional electronic device.

18. The head garment of claim 1 wherein the veil can provide darkness in the interior space.

19. The head garment of claim 1 wherein the head garment is adjustable to fit heads of different sizes.

20. The head garment of claim 1 wherein the veil is constructed of a material configured to at least partially obstruct a view therethrough while permitting some visibility.

21. The head garment of claim 1 wherein the rim is configured to support an audio device, a visual device or an audio-visual device.

* * * * *